US005324063A

United States Patent [19]

Locantro

[11] Patent Number: 5,324,063

[45] Date of Patent: Jun. 28, 1994

[54] SKI RETRIEVAL APPARATUS

[76] Inventor: Mark J. Locantro, 601 Lakeshore Dr., Monroe, La. 71203

[21] Appl. No.: 33,880

[22] Filed: Mar. 19, 1993

[51] Int. Cl.[5] ..... A63C 9/00; A63C 11/16

[52] U.S. Cl. ..... 280/637; 280/809

[58] Field of Search ..... 280/637, 809, 816; 441/73, 75

[56] References Cited

U.S. PATENT DOCUMENTS

| | | | |
|---|---|---|---|
| 3,645,552 | 2/1972 | Kulick | 280/637 X |
| 4,685,697 | 8/1987 | Thorley | 280/637 |
| 4,835,523 | 5/1989 | Pruett | 340/571 |
| 4,919,452 | 4/1990 | Cimino | 280/809 |

FOREIGN PATENT DOCUMENTS

| | | | |
|---|---|---|---|
| 2235202 | 2/1974 | Fed. Rep. of Germany | 280/637 |
| 2406754 | 8/1975 | Fed. Rep. of Germany | 280/637 |
| 2624501 | 12/1977 | Fed. Rep. of Germany | 280/637 |
| 2930502 | 2/1981 | Fed. Rep. of Germany . | |
| 3133240 | 3/1983 | Fed. Rep. of Germany | 280/637 |
| 3406170 | 8/1985 | Fed. Rep. of Germany . | |
| 2419088 | 11/1979 | France | 280/637 |
| 2483242 | 12/1981 | France | 280/637 |
| 8904194 | 5/1989 | PCT Int'l Appl. . | |
| 1336553 | 11/1973 | United Kingdom . | |

*Primary Examiner*—Brian L. Johnson
*Attorney, Agent, or Firm*—John M. Harrison

[57] ABSTRACT

A ski retrieval apparatus for mounting on a snow ski boot and attaching to the ski or ski binding for locating the ski when the skier falls and the ski is dislodged from the binding. The ski retrieval apparatus includes a housing fitted with a drum which receives a length of line, the free end of which extends from the housing and is attached to the binding or ski when the housing is secured to a ski boot. In one embodiment a winding knob projects from the spool and when the ski is dislodged from the boot, the line extends from the housing by rotation of the spool to link the skier with the lost ski. Retrieval of the ski is effected by manually winding the line back on the spool and pulling the ski to the skier. In another embodiment an automatic winding apparatus includes a spring-loaded ratchet which operates such that line is paid out from the housing against spring tension and may be rewound on the rotating drum or spool by releasing the ratchet mechanism and applying spring bias to the spool.

5 Claims, 2 Drawing Sheets

SKI RETRIEVAL APPARATUS

BACKGROUND OF THE INVENTION

1. Field of the Invention

This invention relates to the sport of snow skiing and more particularly, to a ski retrieval apparatus for locating and retrieving skis when the skier falls and one or both skis are released from the ski bindings. On frequent occasions when a skier falls while skiing, each boot is released from the ski bindings upon impact and the skis sometimes slide some distance from the skier, making retrieval difficult. Retrieval of the lost skis is particularly difficult under circumstances where the slope is steep and the skier must laboriously maneuver to the skis, which may be located some distance apart and from the skier, and spend valuable skiing time maneuvering into position again to lock the boots into the ski bindings.

In a preferred embodiment the ski retrieval apparatus of this invention is characterized by a housing designed to fit on each ski boot, with a line wound on a drum located in the housing and the free end of the line attached to the binding or a ski. A ratchet system allows the line to pay out from the housing when one or more skis are dislodged from the boot or boots when the skier falls. The line can then be wound back on the drum, either manually or automatically, to retrieve the ski or skis, which are typically located some distance from the skier. The ski retrieval apparatus thus serves both as a ski locator and as a retrieval device to retrieve one or both skis after the impact of a fall without the necessity of moving to the ski location, a sometimes difficult task, especially on a steep slope.

2. Description of the Prior Art

Various devices for preventing snow skis from travelling downhill after impact when a skier falls and otherwise securing the skis to the skier, are known in the art. U.S. Pat. No. 4,835,523, dated May 30, 1989, to Nicholas Pruett, details a "Ski Beeper". The ski beeper is mounted to the ski in a position where the ski boot depresses an activator button on the device. In the event the ski boot releases from the binding and ski, the spring-loaded activator button raises and in turn, causes the beeper to become activated, thus alerting the skier of the position of the ski. U.S. Pat. No. 4,919,452, dated Apr. 24, 1990, to John J. Cimino, details a "Ski Locator Device Utilizing a Foam Ball". The ski locator device includes a tether having one end attached to the ski and the other connected to a brightly colored foam ball. The foam ball is compacted and inserted in a zippered pouch which is attached either to the skier's leg or to his boot. Upon detachment of the ski from the skier's boot, the foam ball is pulled through an aperture in the pouch and can be readily seen, thereby assisting in locating the ski. German Patent No. 2,930,502, details an "Alarm System" mounted on the ski, which alarm system is activated to locate the ski upon release of the ski from the ski boot and binding. German Patent No. 3,406,170 A1, details a drum having double windings of cord exiting the drum housing from opposite directions, one end of which is provided with a clip and the other with a ring. British Patent No. 1,336,553, details "Tape Measures and Like Articles" which are spring-loaded, wherein the tape extends from a housing under spring bias. PCT Patent No. WO 89/04194, details a "Ski Retriever" which includes a housing having a drum rotatably mounted therein. A cord is secured to and wound around the drum and passes through an aperture in the housing. A clip is disposed at the free end of the cord and the housing is connected to a skier's leg by a coupling, while the clip connects the cord to the ski. In a fall, the cord is drawn out of the housing against the spring bias and the coupling separates. A plate extending around the housing resists embedding of the housing in the snow and aids subsequent location and retrieval of a buried ski or skis.

It is an object of this invention to provide a ski retrieval apparatus for mounting on the boots of a skier and connecting the boots to the respective skis by means of a spring-biased line, wherein the line can be wound into the apparatus housing attached to the boot if the ski or skis are released from the bindings in a fall and are located some distance from the skier.

Another object of the invention is to provide a ski retrieval apparatus having a housing designed for mounting on the boots of the skier, a drum provided in the housing and a line mounted on the drum, with the free end of the line extending from the housing and attached to the ski or binding and a ratchet provided in the housing and engaging the drum to facilitate extension of the line by rotation of the drum in the event that the ski or skis are removed from the boot or boots during a fall and engagement of the drum for manual or automatic rewinding of the line on the drum and retrieval of the ski or skis.

Still another object of this invention is to provide a ski retrieval apparatus, which in a first preferred embodiment is characterized by a housing mounted on the boots of the skier, a line mounted on a spool or drum rotatably fitted in the housing, with the free end of the line attached to the ski binding or ski, a winding knob communicating with the drum, along with a ratchet system provided in the drum and selectively engaging the drum such that the line may be freely extended by rotation of the drum when the ski or skis are removed from the boots during a fall. The line may be then rewound on the drum by manually rotating the knob and drum to retrieve the ski or skis.

Yet another object of this invention is to provide a ski retrieval apparatus which in a preferred embodiment includes a separate housing attached to each boot of the skier, with a rotating spool or drum provided in the housing, a line wound on the drum and a spring-loaded ratchet system fitted within the housing and positioned in selective engagement with the drum, wherein the line is extended through the housing for attachment to the ski or binding. Free extension of the line by rotation of the drum against the spring tension is effected if the ski or skis are removed from the boots during a fall and retrieval of the ski or skis is accomplished by pressing a ratchet disengaging button or trigger to apply spring bias on the drum and rewind the line on the drum.

SUMMARY OF THE INVENTION

These and other objects of the invention are provided in a new and improved ski retrieval apparatus for locating and retrieving one or more skis which may be removed from the skier's boots during a fall, which apparatus includes a housing strapped to each boot, a drum rotatably mounted in the housing and a line wound on the drum, with the free end of the line extending through the housing for attachment to the ski or ski binding and a ratchet device provided in the housing in selective engagement with the drum to facilitate free extension of the line from the drum as the drum rotates when the ski or skis are dislodged from the boot bindings during a fall and rewinding the line on the drum to retrieve the skis. In a preferred embodiment a spring is included in the drum for exerting a bias on the drum and automatically rewinding the line on the drum upon release of the ratchet device from the drum, to retrieve the ski or skis. Alternatively, the spring is omitted and a winding knob is provided to manually wind the line on the drum.

BRIEF DESCRIPTION OF THE DRAWINGS

The invention will be better understood by reference to the accompanying drawings wherein.

DESCRIPTION OF THE PREFERRED EMBODIMENTS

Figure 1:
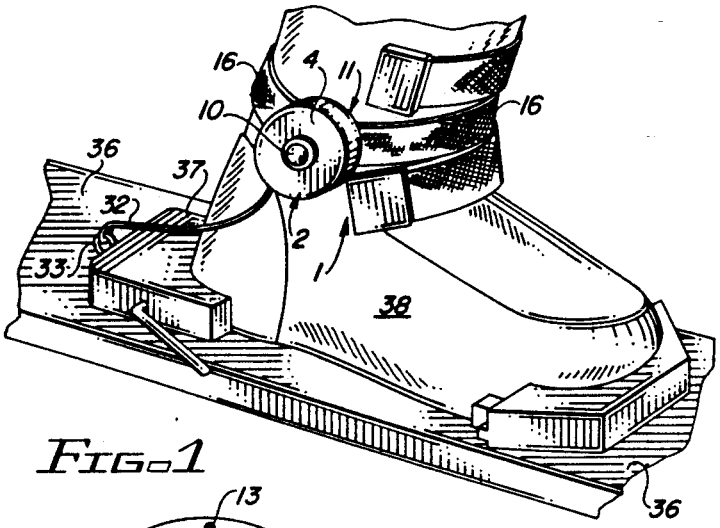
FIG. 1 is a perspective view of a first preferred, automatic rewind embodiment of the ski retrieval apparatus of this invention mounted on a ski boot and connected to a ski.
Figure 2:
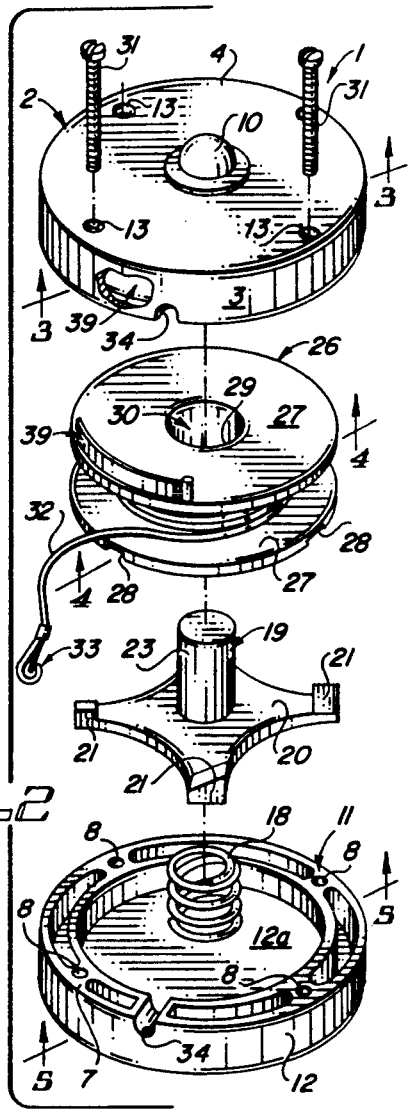
FIG. 2 is an exploded view of the ski retrieval apparatus illustrated in FIG. 1.
Figure 3:
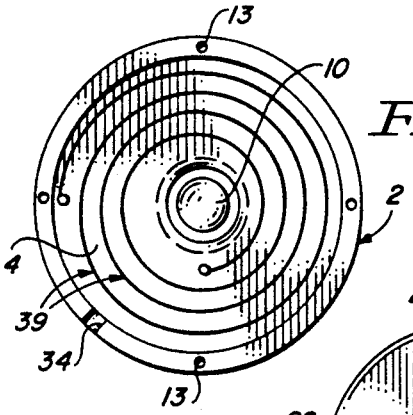
FIG. 3 is a bottom view, taken along line 3—3, of the top housing of the ski retrieval apparatus illustrated in FIGS. 1 and 2.
Figure 4:
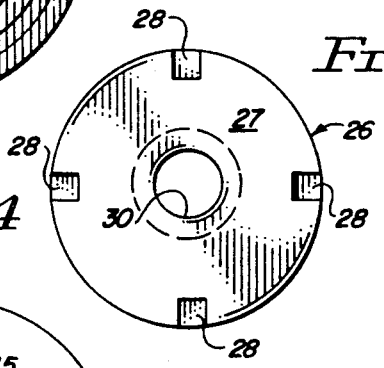
FIG. 4 is a bottom view, taken along line 4—4, of the line drum of the ski retrieval apparatus illustrated in FIG. 2.
Figure 5:
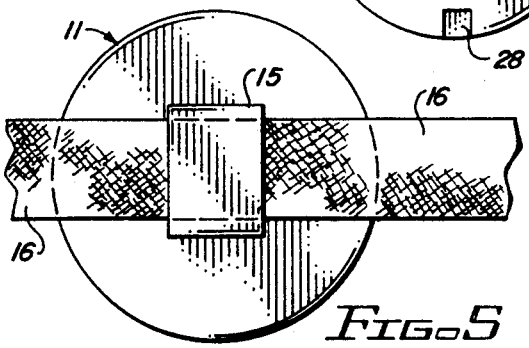
FIG. 5 is a bottom view, taken along line 5—5, of the bottom housing of the ski retrieval apparatus illustrated in FIGS. 1 and 2.
Figure 6:
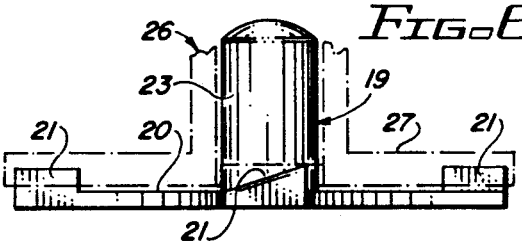
FIG. 6 is a side view of the ratchet mechanism in the ski retrieval apparatus illustrated in FIG. 5.
Figure 7:
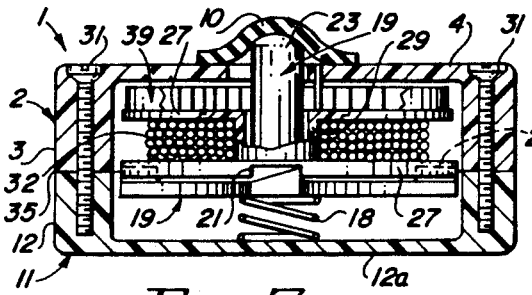
FIG. 7 is a side sectional view of the assembled components of the ski retrieval apparatus illustrated in FIGS. 1 and 2, in line-winding configuration.
Figure 8:
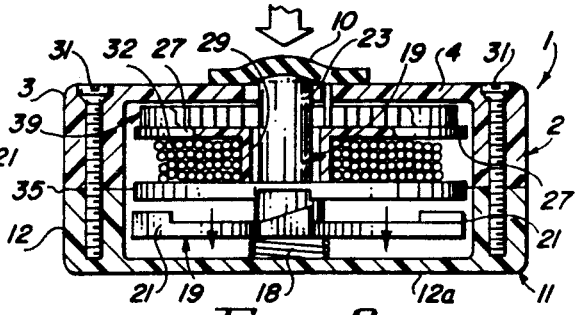
FIG. 8 is a side sectional view of the assembled components of the ski retrieval apparatus illustrated in FIGS. 1 and 2 in line-extension configuration.

Referring initially to FIGS. 1–8 of the drawings in a first embodiment, the ski retrieval apparatus 1 is illustrated as an automatic rewind device and is generally illustrated by reference numeral 1. The ski retrieval apparatus 1 is mounted on a ski boot 38 by means of a strap 16 and is characterized by a top housing 2, having a cylindrical top housing body 3 and provided with four bolt openings 13 for receiving corresponding mount bolts 31. A line tensioning spring 39 is positioned in the top housing 2 and a rubber cap 10 is located on the top housing plate 4 of the top housing 2 and is situated over an opening (not illustrated) centered in the top housing plate 4. A bottom body housing 11 is designed to seat on the top housing 2 along a match line 35 and is characterized by a cylindrical bottom housing body 12, which matches the cylindrical top housing body 3 of the top housing 2. Threaded openings 8 are provided in a bolt mount ring 7 located in the bottom housing body 12 of the body housing 11, for receiving the threaded mount bolts 31 and securing the top housing 2 to the bottom housing 11 along the match line 35, as illustrated in FIGS. 1, 7 and 8. As illustrated in FIGS. 2 and 3, a line drum 26 is seated inside the top housing body 3 against the line tensioning spring 39 and is characterized by a pair of flat drum plates 27, spaced by a spool 29, having a spool bore 30. One end of the line tensioning spring 39 is attached to the top one of the drum plates 27, while the opposite end is secured to the top housing plate 4 of the top housing 2, for tensioning rotation of the line drum 26. Four tooth slots 28 are provided in spaced relationship on the bottom one of the drum plates 27 and one end of a line 32 is attached to the spool 29, while the opposite end of the line 32 projects through a line opening 34 located in the top housing body 3 and the bottom housing body 12 at the match line 35, as illustrated in FIG. 2. A line hook 33 is attached to the free end of the line 32, as further illustrated in FIG. 2. As illustrated in FIGS. 2, 6, 7 and 8, a ratchet 19 is also provided in the top housing 2 and bottom housing 1 1, beneath the line drum 26. The ratchet 19 includes a flat ratchet plate 20, fitted with four spaced, bevelled ratchet teeth 21 which are designed to selectively seat in the respective tooth slots 28 of the bottom one of the drum plates 27 in the line drum 26, as hereinafter further described. Each of the ratchet teeth 21 are bevelled from top to bottom as illustrated in FIGS. 2 and 6, to facilitate selective engagement and disengagement with the respective tooth slots 28 and allow extension and rewinding of the line 32 from and on the rotating line drum 26, respectively, as hereinafter further described. A ratchet trigger 23 projects upwardly from the center of the ratchet plate 20 and extends through the spool bore 30 provided in the center of the spool 29 of the line drum 26. A ratchet spring 18 is located beneath the ratchet plate 20 and seats against the bottom housing plate **12*a* to normally bias the ratchet teeth 21 of the ratchet 19 into the respective tooth slots 28 of the bottom drum plate 27, as illustrated in FIG. 7. Accordingly, it will be appreciated from consideration of FIGS. 2 and 8 of the drawings, that extension of the line 32 from the top housing 2 and bottom housing 11 through the line opening 34 by counterclockwise rotation of the line drum 26, causes the line tensioning spring 39 to tighten as the tooth slots 28 rotate in a circular path against the wedge-shaped surfaces of the respective ratchet teeth 21 by virtue of the bevel in each of the ratchet teeth 21. Rewinding of the ski retrieval apparatus 1 is effected by engagement of these ratchet teeth 21 in the corresponding tooth slots 28, as the line drum 26 rotates in the clockwise direction, as illustrated in FIG. 7**.

As illustrated in FIG. 1, the ski retrieval apparatus 1 is attached to the ski boot 38 by means of the strap 16 and the line hook 33 is secured to the ski binding 37 of a ski 36. The ski retrieval apparatus 1 is then operable to locate and retrieve the ski 36 in the event that the skier falls and the ski 36 is released from the ski binding 37. In such an event, the line 32 is extended from the top housing 2 and bottom housing 1 1 against the bias in the line tensioning spring 39, as the tooth slots 28 rotate past each of the respective ratchet teeth 21, as illustrated in FIG. 7. The ski retrieval apparatus 1 is then used to retrieve the ski from a position located at a distance from the skier by pressing the rubber cap 10, which in turn depresses the ratchet trigger 23 and releases the respective ratchet teeth 21 from engagement with the corresponding tooth slots 28. This facilitates free rotation of the line drum 26 on the ratchet trigger 23 by operation of the line tensioning spring 39, as illustrated in FIG. 8, which causes the line 32 to rewind on the spool 29 between the drum plates 27 and pull the ski 36 to the skier. When the line 32 is rewound on the line drum 26, pressure on the rubber cap 10 is released and the ski boot 38 may be again inserted in the ski binding 37 in conventional fashion to reorient the ski retrieval apparatus 1 in operational configuration as illustrated in FIG. 1.

Figure 10:
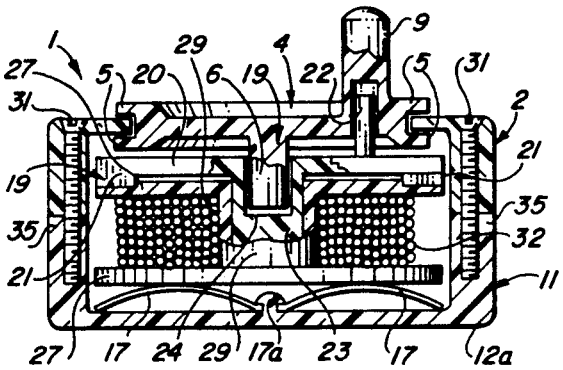
FIG. 10 is a side sectional view of the components of the ski retrieval apparatus illustrated in FIG. 9 in line-winding configuration.
Figure 9:
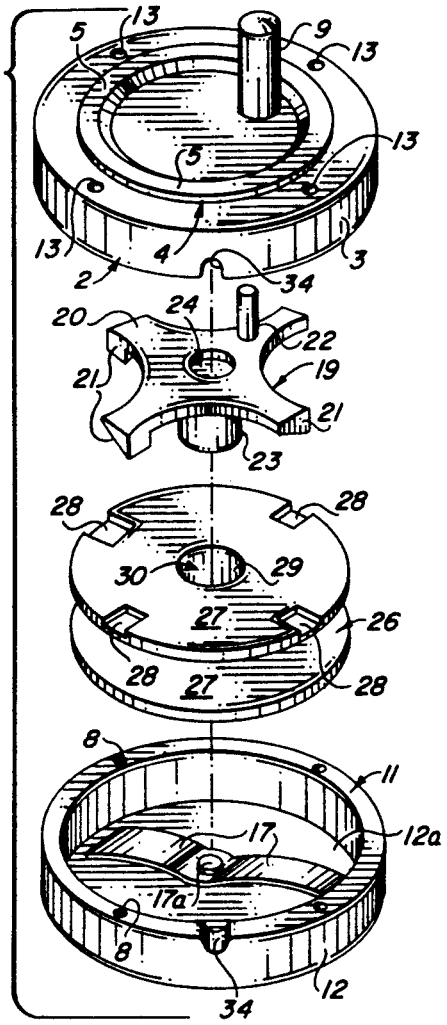
FIG. 9 is an exploded view of a second preferred, manual rewind embodiment of the ski retrieval apparatus of this invention.
Figure 11:
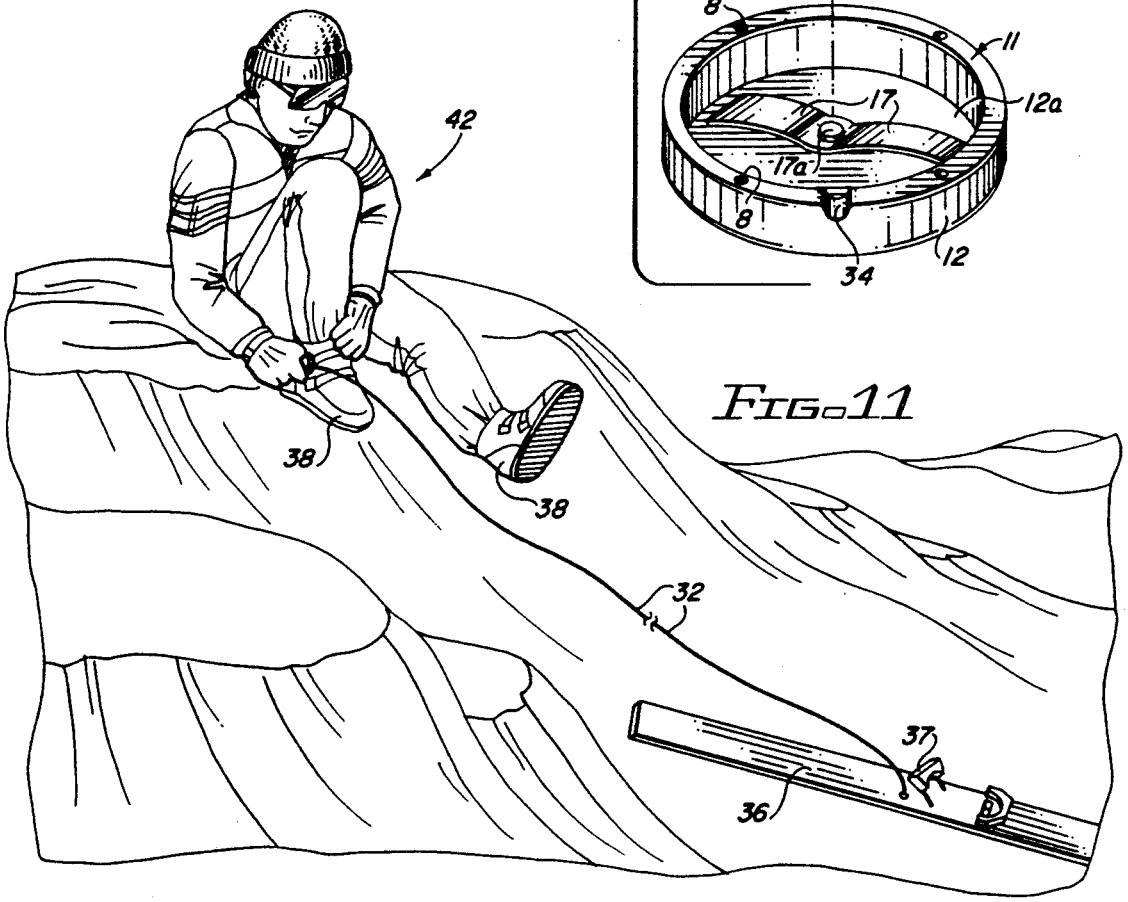
FIG. 11 is a perspective view of a skier and ski located some distance from the skier, illustrating operation of the ski retrieval apparatus illustrated in FIGS. 10 and 11.

In a second preferred embodiment of the invention a manual rewind ski retrieval apparatus 1 is illustrated in FIGS. 9–11 of the drawings. In this embodiment of the invention the ski retrieval apparatus 1 includes a top housing 2 and a bottom housing 1 1, the top housing 2 of which is fitted with a rotating top housing plate 4 which engages the top housing body 3 by means of circular plate fingers 5. A plate lug 6 projects downwardly from the center of the top housing plate 4 into a lug receptacle 24 of the ratchet trigger 23, as illustrated in FIG. 10, and a winding knob guide 9 extends upwardly in off-center relationship from the top housing plate 4, as illustrated in FIGS. 9 and 10. The ratchet 19 is positioned above the line drum 26 in the ski retrieval apparatus 1 illustrated in FIGS. 9–11 and the ratchet trigger 23 projects downwardly through the spool bore 30 of the spool 29 in the line drum 26, with four ratchet teeth 21 engaging corresponding tooth slots 28 provided in the top one of the drum plates 27, as illustrated. The ratchet 19 is also provided with a ratchet knob 22 which projects upwardly and off-center from the ratchet plate 20 and extends inside the hollow interior of the winding knob guide 9 when the ski retrieval apparatus 1 is assembled as illustrated in FIG. 10. When in assembled configuration, the plate lug 6 projects downwardly from the center of the top housing plate 4 and extends into the corresponding lug receptacle 24, provided in the ratchet plate 20 and ratchet trigger 23 of the ratchet 19, to substantially seat the ratchet 19 on the line drum 26 inside the top housing 2. The top housing 2 is assembled to the bottom housing 11 along the match line 35 by means of multiple bolt openings 13, provided in the top housing 2 which receive corresponding mount bolts 31, wherein the mount bolts 31 are threadably attached to aligned threaded openings 8 located in the bottom housing 11. As in the case of the ski retrieval apparatus illustrated in FIGS. 1–8, a line 32 is wound on the spool 29 of the line drum 26 and projects through a corresponding line opening 34 at the match line 35 and is fitted with a line hook 33 for attachment to the binding 37 located on a ski 36, as illustrated in FIG. 1 of the drawings. A pair of leaf springs 17 are mounted on the bottom housing plate **12*a* of the bottom housing body 12 by means of a spring mount 17*a*, to bias the line drum 26 inside the bottom housing 11 when the ski retrieval apparatus 1 is assembled as illustrated in FIG. 10. Accordingly, the line 32 is unwound from the rotating line drum 26 when the ski is detached from the bindings 37 as illustrated in FIG. 11 and the line drum 26 rotates in the counterclockwise direction as viewed in FIG. 9, against the bias in the leaf springs 17. This facilitates a smooth payout of line from the spool 29 as the wedge-shaped surfaces of the ratchet teeth 21 slide over the respective tooth slots 28 in the top drum plate 27. Retrieval of the ski 36 is then effected by grasping the winding knob guide 9 and rotating the top housing plate 4, along with the ratchet 19 and the line drum 26, in the clockwise direction. This winding operation is facilitated by engagement between the bevelled ratchet teeth 21 and the corresponding tooth slots 28 as in the case of the ski retrieval apparatus illustrated in FIGS. 1–8. Further as in the case of the ski retrieval device illustrated in FIGS. 1–8, a strap 16, mounted on a strap mount 15 attached to the bottom housing 11, is used to secure the ski retrieval apparatus 1 to the boot 38** in functional configuration.

It will be appreciated by those skilled in the art that the ski retrieval apparatus of both embodiments of this invention operates to quickly and effectively retrieve one or more skis which are located some distance from the skier resulting from a fall, with minimum delay and maximum utilization of skiing time. It will be further understood that various components of the ski retrieval apparatus 1 may be constructed of metal, plastic or other materials of construction well known to those skilled in the art. Furthermore, the size of the top housing 2 and matching bottom housing 11 in the embodiment illustrated in FIGS. 1–8 can be selected to accommodate a line tensioning spring 39 of sufficient tension and size to allow the use of a line 32 of sufficient length to avoid sudden and heavy jerks on the skiers ski boot 38 during a fall.

Accordingly, while the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. A ski retrieval apparatus for connecting a snow ski to a ski boot and retrieving the snow ski, comprising a housing; attachment means connected to said housing and engaging the ski boot for securing said housing on the ski boot; a drum disposed for rotation in said housing; at least two tooth slots provided in said drum in spaced relationship with respect to each other; a line wound on said drum, with one end of said line attached to said drum and the opposite end of said line extending from said housing and attached to the snow ski; ratchet means provided in said housing and at least two bevelled teeth projecting from said ratchet means in spaced relationship with respect to each other for engaging said tooth slots in a line-winding direction of rotation of said ratchet means and said drum and disengaging said tooth slots in a line-unwinding direction of rotation of said drum; a line-tensioning spring provided in said housing, with one end of said line-tensioning spring connected to said housing and the opposite end of said line-tensioning spring connected to said drum; and ratchet trigger means carried by said ratchet means and projecting through said housing for selectively disengaging and said ratchet teeth from said tooth slots against the bias of said line-tensioning spring and rotating said drum in said line-winding direction and winding said line on said drum and retrieving the snow ski responsive to operation of said line-tensioning spring.

2. The ski retrieval apparatus of claim 1 comprising drum tensioning spring means provided in said housing and engaging said drum for tensioning the rotation of said drum in said housing.

3. The ski retrieval apparatus of claim 2 wherein said housing comprises a top housing and a bottom housing closing on said top housing along a match line for assembling said drum, said line-tensioning spring and said ratchet means in said top housing and said bottom housing.

4. The ski retrieval apparatus of claim 3 wherein said attachment means comprises strap means attached to said bottom housing for removably attaching said bottom housing and said top housing to the ski boot.

5. A ski retrieval apparatus for mounting on a ski and connecting the ski to a ski boot and retrieving the ski, comprising a split housing; attachment means carried by said split housing and engaging the ski boot for securing said split housing on the ski boot; a drum disposed for rotation in said split housing; a drum-tensioning spring provided in said split housing and engaging said drum for tensioning the rotation of said drum in said split housing; at least two tooth slots provided in said drum in spaced relationship with respect to each other; a line opening provided in said split housing; a line wound on said drum, with one end of said line attached to said drum and the opposite end of said line extending from said line opening in said split housing and attached to the snow ski; a ratchet disposed for rotation in said split housing and at least two bevelled teeth projecting from said ratchet in spaced relationship with respect to each other for engaging said tooth slots in a line-winding direction of rotation of said ratchet and said drum and disengaging said tooth slots in a line-unwinding direction of rotation of said drum; a line-tensioning spring provided in said split housing, with one end of said line-tensioning spring connected to said said split housing and the opposite end of said line-tensioning spring connected to said drum; and a ratchet trigger carried by said ratchet and projecting through said drum and said housing for manually selectively disengaging said ratchet teeth from said tooth slots against the bias of said line-tensioning spring rotating said drum in said line-winding direction and winding said line on said drum and retrieving the snow ski responsive to operation of said line-tensioning spring.

* * * * *